US009713881B2

(12) United States Patent
Zimmermann et al.

(10) Patent No.: US 9,713,881 B2
(45) Date of Patent: Jul. 25, 2017

(54) HANDHELD WORK APPARATUS HAVING A TENSIONING DEVICE FOR A CHAIN

(71) Applicant: Andreas Stihl AG & Co. KG, Waiblingen (DE)

(72) Inventors: Helmut Zimmermann, Berglen (DE); Jonas Lank, Winnenden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 184 days.

(21) Appl. No.: 14/198,234

(22) Filed: Mar. 5, 2014

(65) Prior Publication Data

US 2014/0250702 A1 Sep. 11, 2014

(30) Foreign Application Priority Data

Mar. 6, 2013 (DE) ..... 10 2013 003 850

(51) Int. Cl.
*B27B 17/14* (2006.01)

(52) U.S. Cl.
CPC ..... *B27B 17/14* (2013.01)

(58) Field of Classification Search
CPC ..... B27B 17/14
USPC ..... 30/381–387
See application file for complete search history.

(56) References Cited

U.S. PATENT DOCUMENTS 3,636,995 A * 1/1972 Newman ..... B27B 17/14 30/386
4,129,943 A * 12/1978 Bricker ..... B27B 17/14 30/386
4,382,334 A * 5/1983 Reynolds ..... B23D 63/168 30/386
4,835,868 A * 6/1989 Nagashima ..... B27B 17/14 30/386
5,396,705 A * 3/1995 Leini ..... B27B 17/02 30/386
5,491,899 A * 2/1996 Schliemann ..... B27B 17/14 30/386
5,522,143 A * 6/1996 Schliemann ..... B27B 17/14 30/386
5,528,835 A * 6/1996 Ra ..... B27B 17/14 30/386

(Continued)

FOREIGN PATENT DOCUMENTS

DE 10 2006 035 744 A1 2/2008
DE 102013003850 * 9/2014 ..... B27B 17/14

(Continued)

*Primary Examiner* — Jason Daniel Prone
(74) *Attorney, Agent, or Firm* — Walter Ottesen, P.A.

(57) ABSTRACT

A handheld work apparatus has a guide bar having a periphery along which a chain runs. The work apparatus has a housing and a fastening arrangement for fixing the guide bar to the housing. The fastening arrangement has an actuating device which can be actuated in a fastening direction in order to fix the guide bar. The work apparatus has a tensioning device to tension the chain. The tensioning device includes a tensioning spring. When the fastening arrangement is loosened, the tensioning spring exerts a force in a tensioning direction of the chain on the guide bar. Simple operation and a simple construction are achieved if the tensioning spring is in operative connection with the actuating device and is tensioned during actuation of the actuating device in the fastening direction.

15 Claims, 12 Drawing Sheets

(56) References Cited

U.S. PATENT DOCUMENTS 6,105,263 A * 8/2000 Stones ..... B27B 17/083 30/383
6,237,228 B1 * 5/2001 Moody ..... B27B 17/14 30/386
6,493,949 B2 * 12/2002 Kondo ..... B27B 17/14 30/386
6,532,671 B1 * 3/2003 Jong ..... B27B 17/14 30/386
6,560,879 B2 * 5/2003 Franke ..... B27B 17/14 30/386
6,564,459 B1 * 5/2003 Steinbrueck ..... B27B 17/14 30/386
6,782,627 B2 * 8/2004 Hermes ..... B27B 17/14 30/386
6,877,233 B1 * 4/2005 Franke ..... B27B 17/14 30/386
6,878,888 B1 * 4/2005 Jong ..... B27B 17/083 30/382
7,107,689 B2 * 9/2006 Keeton ..... B27B 17/14 30/386
7,350,301 B2 * 4/2008 Chung Lee ..... B27B 17/14 30/386
7,434,502 B2 * 10/2008 Keeton ..... B27B 17/14 30/386
7,600,323 B2 * 10/2009 Sugishita ..... B27B 17/14 30/386
7,676,934 B2 * 3/2010 Liao ..... B27B 17/14 30/386
7,743,513 B1 * 6/2010 Fisher ..... B27B 17/14 30/386
8,365,420 B2 * 2/2013 Pellenc ..... B27B 17/14 30/386
8,434,236 B2 * 5/2013 Pellenc ..... B27B 17/14 30/386
8,495,819 B2 * 7/2013 Okouchi ..... B27B 17/14 30/386
8,931,575 B2 * 1/2015 Okouchi ..... B25F 5/02 173/171
9,573,208 B2 * 2/2017 Takayanagi ..... B23D 57/023 30/386
2007/0062361 A1 * 3/2007 Xiong ..... B27B 17/14 83/814
2009/0241353 A1 * 10/2009 Ericson ..... B27B 17/14 30/386
2011/0167650 A1 * 7/2011 Buttery ..... B27B 17/14 30/386
2011/0308096 A1 * 12/2011 Yu ..... B27B 17/14 30/386
2011/0314682 A1 * 12/2011 Maag ..... B27B 17/14 30/386
2012/0036725 A1 * 2/2012 Osborne ..... B27B 17/083 30/383
2013/0086810 A1 * 4/2013 Peterson ..... B27B 17/14 30/386
2013/0345003 A1 * 12/2013 Maag ..... B27B 17/14 474/117
2014/0047722 A1 * 2/2014 Onose ..... B27B 17/00 30/383
2014/0283395 A1 * 9/2014 Fu ..... B27B 17/12 30/381
2014/0290074 A1 * 10/2014 Takayanagi ..... B23D 57/023 30/382
2014/0290075 A1 * 10/2014 Takayanagi ..... B27B 17/14 30/386
2014/0290076 A1 * 10/2014 Takayanagi ..... B27B 17/14 30/386
2015/0038275 A1 * 2/2015 Saitoh ..... B27B 17/14 474/113
2015/0135542 A1 * 5/2015 Cook ..... B27B 17/14 30/386
2016/0039110 A1 * 2/2016 Schiedt ..... B27B 17/14 30/386
2016/0346953 A1 * 12/2016 Lee ..... B27B 17/14 30/386
2017/0043421 A1 * 2/2017 Nie ..... B23D 57/023 30/386

FOREIGN PATENT DOCUMENTS

DE EP 2774733 A1 * 9/2014 ..... B27B 17/14
EP 1 637 299 A1 3/2006
EP 2 036 688 A2 3/2009
GB 2 355 226 A 4/2001
GB 2 481 038 A 12/2011

* cited by examiner

HANDHELD WORK APPARATUS HAVING A TENSIONING DEVICE FOR A CHAIN

CROSS REFERENCE TO RELATED APPLICATION

This application claims priority of German patent application no. 10 2013 003 850.2, filed Mar. 6, 2013, the entire content of which is incorporated herein by reference.

BACKGROUND OF THE INVENTION

DE 10 2006 035 744 discloses a device for automatically tensioning a chain of a chain saw. The device has a helical spring which is supported with one end on the housing and with a second end on an adjusting cam. In order to replace the chain, a separate latching cam has to be actuated, in order to relieve the saw chain.

GB 2 481 038 A discloses a tensioning device for a chain, in which tensioning device a latching device is provided which holds the tensioning spring in a stressed state when the sprocket wheel cover is removed.

SUMMARY OF THE INVENTION

It is an object of the invention to provide a handheld work apparatus having a tensioning device for a chain, wherein the handheld work apparatus makes simple tensioning and replacing of the chain possible.

The handheld work apparatus of the invention includes: a guide bar; a work tool configured as a chain defining a tensioning direction and arranged peripherally on the guide bar; a housing; a fastening arrangement configured to fix the guide bar on the housing; the fastening arrangement defining a loosened state and having an actuating device configured to be actuated in a fastening direction to fixate the guide bar; a tensioning device configured for the chain; the tensioning device having a tensioning spring configured to apply a force on the guide bar in the tensioning direction of the chain when the fastening arrangement is in the loosened state; and, the tensioning spring being operatively connected to the actuating device and being configured to be tensioned when the actuating device is actuated in the fastening direction.

It is provided that the tensioning spring is stressed during the actuation of the actuating device in the fastening direction. Here, the fastening direction of the actuating device is the direction, in which the actuating device is to be actuated in order to fix the guide bar. Accordingly, the tensioning spring is stressed to its maximum when the fastening arrangement fixes the guide bar. The chain is tensioned during fastening of the guide bar, that is, during actuation of the actuating device in the fastening direction. If the fastening arrangement is released, for example in order to change the chain or the guide bar, the tensioning spring is advantageously relieved at least partially. As a result, no additional devices are necessary which interrupt the operative connection between the tensioning spring and the guide bar and hold the tensioning spring in the stressed state during the change of the guide bar.

The work apparatus advantageously has an arresting unit which prevents the tensioning spring from being relieved in the case of a partially released actuating device. As a result, a backward movement of the actuating device counter to the fastening direction is prevented during the stressing of the tensioning spring. The arresting unit advantageously includes a friction band which acts against a friction surface. The friction band can advantageously enter into an operative connection with the actuating device and with the tensioning spring. During actuation of the actuating device in the fastening direction, the actuating device advantageously acts on the friction band in the direction which reduces the frictional force. As a result, the frictional resistance is reduced, with which the friction band counteracts the actuation in the actuating direction, that is, the tightening of the actuating device. The tensioning spring advantageously acts on the friction band in the direction which increases the frictional force. As a result, the tensioning spring is prevented from being relieved by the friction band. During the actuation in the release direction, it is advantageously provided that the actuating device acts on the friction band in the direction which increases the frictional force. It can also be provided, however, that the actuating device also acts on the friction band in the direction which reduces the frictional force during the actuation in the release direction. The actuating device advantageously acts against a first end of the friction band during the actuation in the fastening direction and against a second end of the friction band during the actuation in the release direction.

The friction band is advantageously configured in one piece with the tensioning spring. As a result, the number of required individual parts is reduced, and this results in simple assembly. However, it can also be provided that the friction band is configured separately from the tensioning spring. As a result, the friction band and the tensioning spring can be of simple configuration. The tensioning spring is advantageously arranged in a separate spring housing. The arrangement of the tensioning spring in a separate spring housing results in simple assembly of the overall arrangement and satisfactory protection of the tensioning spring against contaminants. The spring housing is held, in particular, on the actuating device. This results in a compact construction. The spring housing is advantageously arranged at least partially in the actuating device. The tensioning spring is advantageously relieved in the case of a completely released fastening arrangement. As a result, the tensioning device can be removed simply from the guide bar or can be arranged on the guide bar. The tensioning spring can be a helical spring. Helical springs are usually arranged in a housing which absorbs the force which is exerted by the outer winding or windings. In the present case, a completely relieved helical spring is understood to mean a helical spring, in which no spring force acts on the inner end. The outer windings can nevertheless be under stress here, the force being absorbed by the spring housing. A completely relieved helical spring is a helical spring, in which the inner end does not exert any torque with respect to the outer end.

The tensioning travel of the tensioning spring and the maximum actuating travel of the actuating device are advantageously adapted to one another. Here, the maximum tensioning travel of the tensioning spring is advantageously greater than the maximum actuating travel of the fastening arrangement. This ensures that the tensioning spring cannot be stressed to an impermissibly great extent during the adjustment of the actuating device in the actuating direction. If the tensioning spring is a helical spring and the fastening arrangement has a thread which is screwed onto a mating thread or screwed out of the mating thread for fastening and release of the guide bar, it is advantageously provided that the permissible number of revolutions, by which the ends of the helical spring can be rotated with respect to one another during stressing of the tensioning spring, is greater than the number of thread turns of the fastening arrangement, into which the fastening arrangement can be screwed until complete fixing of the guide bar.

The tensioning spring is advantageously a helical spring, and the actuating device can be rotated in the actuating direction and in the release direction. This results in simple, intuitive operation of the fastening arrangement. In order to fasten and tension the guide bar or chain, the actuating device merely has to be rotated in the actuating direction. The tensioning spring is stressed in the process and simultaneously tensions the chain. The actuating device advantageously has a thread. The rotational movement of the actuating device causes, via the thread, a movement of the actuating device transversely with respect to the plane of the guide bar. During the actuation of the actuating device, the guide bar can be clamped by the movement of the actuating device transversely with respect to the plane of the guide bar and the tensioning device can be tensioned via the rotational movement of the actuating device. Here, the actuating device can advantageously be rotated until the guide bar is held on the housing of the work apparatus in a clamped manner. In order to release it, the actuating device is rotated in the release direction. Here, the helical spring is relieved at the same time, with the result that a simple replacement of the chain or the guide bar is possible. The rotational movement of the actuating device in the release direction at the same time causes, via the thread, a movement of the actuating device transversely with respect to the plane of the guide bar, as a result of which the clamping action of the guide bar is released.

A simple construction results if the tensioning spring is arranged in an interior space which is delimited at least partially by the actuating device. The fastening region of the guide bar is advantageously covered by a sprocket wheel cover which has a receptacle for the tensioning device. This results in a simple, compact construction. The tensioning device can also be retrofitted simply to existing work apparatuses by way of the exchange of the sprocket wheel cover.

The tensioning device advantageously has a displacement guide, each rotary position of the displacement guide being assigned a position of the guide bar. The rotational movement which is caused by the tensioning device can be converted in a simple way into a longitudinal movement of the guide bar via the displacement guide. The displacement guide is, in particular, a helical guide, in which a pin is guided. In order to permit a displacement of the guide bar counter to the tensioning direction, for example if the chain is overtensioned on account of thermal distortion, it is advantageously provided that the pitch angle of the helical guide is configured in such a way that the displacement guide is not self-locking in the direction opposite to the tensioning direction. This ensures that the tension in the chain does not exceed the tension which is provided by the tensioning device. The displacement guide is advantageously in an operative connection with the tensioning spring.

In order to reliably prevent automatic loosening of the tensioning device, for example on account of vibrations during operation, it is advantageously provided that the tensioning device has a securing device which secures the rotary position of the displacement guide in a positively locking manner. Here, the securing device is advantageously configured in such a way that it does not act until immediately before the completely fixed position of the actuating device is reached, with the result that the actuating and release of the actuating device is not made more difficult by the securing device.

A simple construction results if the displacement guide is formed on a spring housing of the tensioning spring. As a result, no separate component is necessary for the displacement guide.

The work apparatus advantageously has a fixing means for the actuating device. The fixing means secures the actuating device in a positively locking manner with respect to a housing part. As a result, unintentional rotation of the actuating device can be prevented during operation, for example on account of vibrations. A simple configuration results if the actuating device has a pivotable bracket which is connected fixedly to the housing part so as to rotate with it in a fastening position and permits an actuation of the actuating device in an actuating position. Simple operation is achieved as a result. In order to release the actuating device, the pivotable bracket has to be pivoted into the actuating position. The actuating device can subsequently be actuated, for example rotated.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
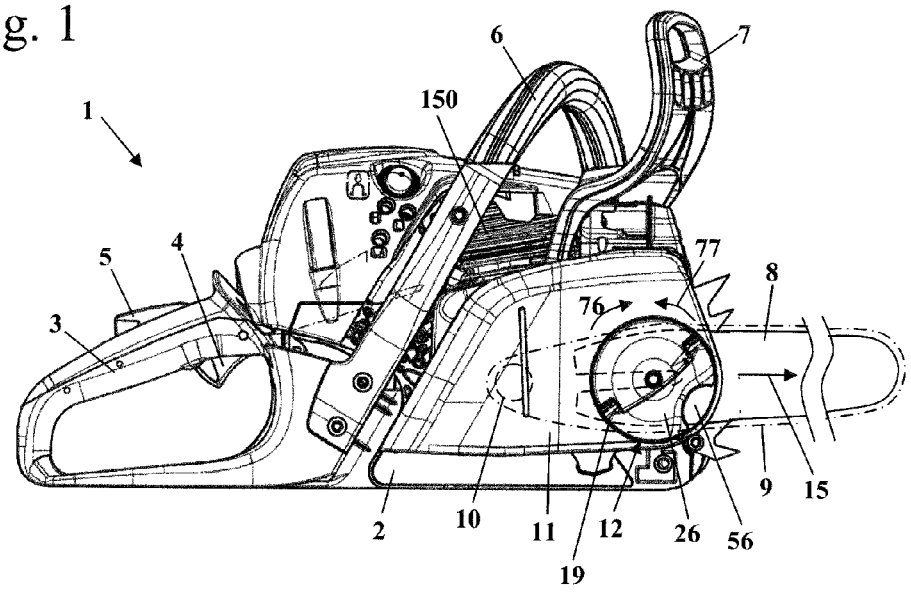
FIG. 1 is a diagrammatic side view of a chain saw.

FIG. 1 shows a chain saw 1 as an embodiment for a handheld work apparatus. The chain saw 1 has a housing 2, on which a guide bar 8 is fixed via a fastening arrangement 12. A chain 9, which is driven by a sprocket wheel 10, is guided in a circulating manner on the guide bar 8. The chain 9 is configured as a saw chain. However, the work apparatus can also be a stonecutter, in which a chain 9, which is configured as a cutting chain, is arranged on the guide bar 8 for cutting stone. In order to tension the chain 9, the guide bar 8 is moved with respect to the housing 2 in a tensioning direction 15 which is directed from the housing 2 in the direction of the free end of the guide bar 8. The free end of the guide bar projects away from the housing 2. That region of the guide bar 8, which is fixed on the housing 2, is covered by a sprocket wheel cover 11, just as the sprocket wheel 10.

A rear handle 3 is arranged on the housing 2 for guiding the chain saw 1 during operation. A throttle lever 4 and a throttle lever lock 5 are mounted pivotably on the rear handle 3. A drive motor 150, which is arranged in the housing 2, can be operated via the throttle lever 4. In the embodiment, the drive motor 150 is configured as an internal combustion engine. However, the drive motor 150 can also be an electric motor which is connected to an energy supply via a connecting cable or which is supplied with power from a battery or a rechargeable battery.

The chain saw 1 has a tubular handle 6 which extends over the housing 2 of the chain saw 1, and a hand guard 7 which extends on that side of the tubular handle 6 which faces the guide bar 8. The hand guard 7 advantageously serves to trigger a brake device (not shown) for the saw chain 9.

The fastening arrangement 12 can be actuated via an actuating device 19 which is configured as a rotary wheel in the embodiment. In the non-actuated state (shown in FIG. 1) of the actuating device 19, the actuating device 19 terminates approximately flush with the outer side of the sprocket wheel cover 11. In order to actuate the actuating device 19, a bracket 26 of the actuating device 19 has to be folded to the outside. In order that the operator can grip the bracket 26 satisfactorily, a handle recess 56 is provided on the bracket 26. In order to release the fastening arrangement 12, the actuating device 19 is rotated in the release direction 77 which runs in the rotational direction counter to the clockwise direction in the embodiment. In order to fix the guide bar 8, the actuating device is rotated in a fastening direction 76. In the embodiment, the fastening direction 76 is oriented in the clockwise direction. Instead of a rotary movement of the actuating device 19, another movement of the actuating device 19 can also be provided, for example a linear movement along the sprocket wheel cover 11.

Figure 4:
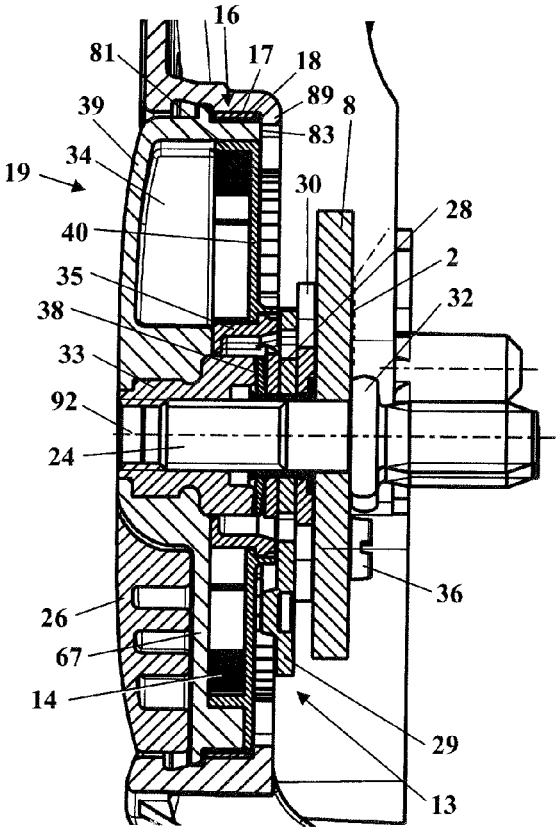
FIG. 4 shows a section through the fastening region of the guide bar.

In order to tension the chain 9, the chain saw 1 has a tensioning device 13 which is shown in FIG. 4. The tensioning device 13 includes a tensioning spring 14 (shown in FIG. 4) which is configured as a helical spring in the embodiment. The tensioning spring 14 acts on a displacement guide, which will be described in greater detail below, and which is likewise part of the tensioning device 13 and converts the rotational movement of the tensioning spring 14 into a longitudinal movement of the guide bar 8 in the tensioning direction 15 which is shown in FIGS. 1 and 2.

Figure 2:
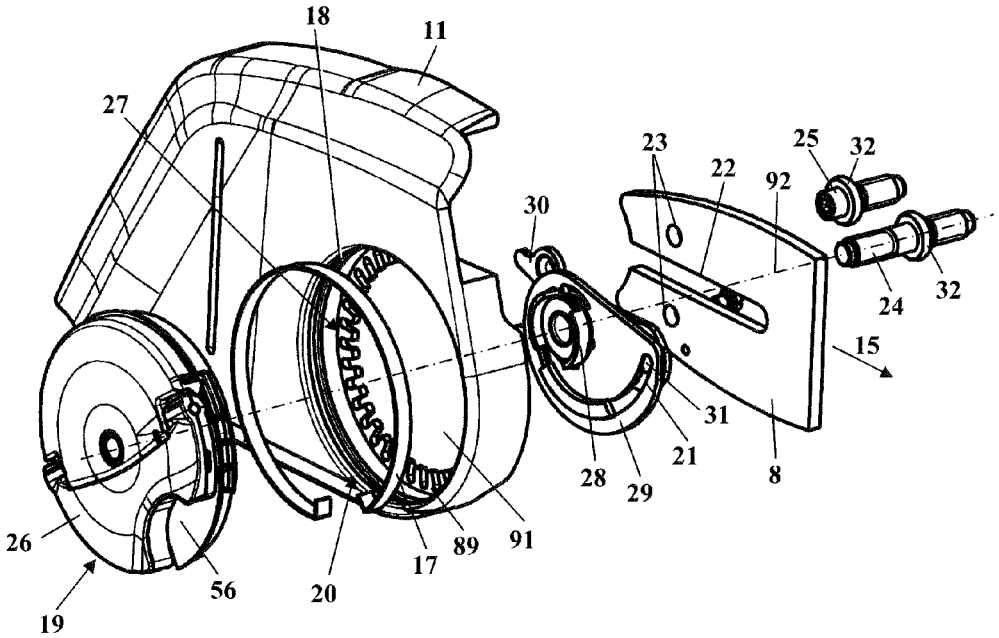
FIG. 2 is a perspective exploded view of the fastening region of the guide bar of the chain saw from FIG. 1.

FIG. 2 shows a part of the tensioning device 13 in an exploded view. That part of the tensioning device 13 which is arranged in the actuating device 19 cannot be seen in this view. The sprocket wheel cover 11 has a receptacle 20, the base 89 of which has an opening 91. The opening 91 extends over a large part of the end side of the receptacle 20, with the result that the base 89 is formed substantially by a circumferential edge. The base 89 has a tooth contour 27, the function of which will be explained in further detail below. A friction surface 18, against which a friction band 17 acts, is formed on the outer circumference of the receptacle 20. The friction band 17 is arranged on the outer circumference of the actuating device 19 between the actuating device 19 and the friction surface 18. Together with the friction surface 18, the friction band 17 forms an arresting unit 16, the function of which will be described in further detail below. The tensioning device 13 includes a rotary element 29 and a displacement element 30 which are arranged on the inner side of the sprocket wheel cover 11, which inner side faces the housing 2. An entrainer 28 is held fixedly on the rotary element 29 so as to rotate therewith. The entrainer 28 serves for the rotationally fixed connection to one end of the tensioning spring 14 (FIGS. 3 and 4), as will be described in further detail below. The rotary element 29 has a helical guide 21 as displacement guide. A lug 31 of the displacement element 30 is arranged in the helical guide 21. The displacement element 30 projects with retaining lugs 50 (shown in FIG. 3) into openings 23 of the guide bar 8 and is connected fixedly to the guide bar 8 so as to rotate therewith as a result.

A fastening bolt 24 and a guide bolt 25 which each have a collar 32 for bearing against the guide bar 8 are fixed on the housing 2 of the chain saw 1. The fastening bolt 24 and the guide bolt 25 project through a longitudinal groove 22 of the guide bar 8. Moreover, the fastening bolt 24 and the guide bolt 25 project through a longitudinal slit 41 (shown in FIG. 5) of the displacement element 30. As a result, the displacement element 30 and the guide bar 8 can move only in the tensioning direction 15 which is oriented in the direction of the longitudinal groove 22 and the longitudinal slit 41, and in the opposite direction with respect to the housing 2. A rotation of the rotary element 29 about the rotational axis 92 brings about a movement of the lug 31 in the helical guide 21. As a result, the spacing of the lug 31 from the rotational axis 92 of the rotary element 29 changes. The rotational axis 92 is the rotational axis of the actuating device 19. The displacement element 30 is displaced in the tensioning direction 15 if the spacing between the lug 31 and the rotational axis 92 is reduced.

Figure 3:
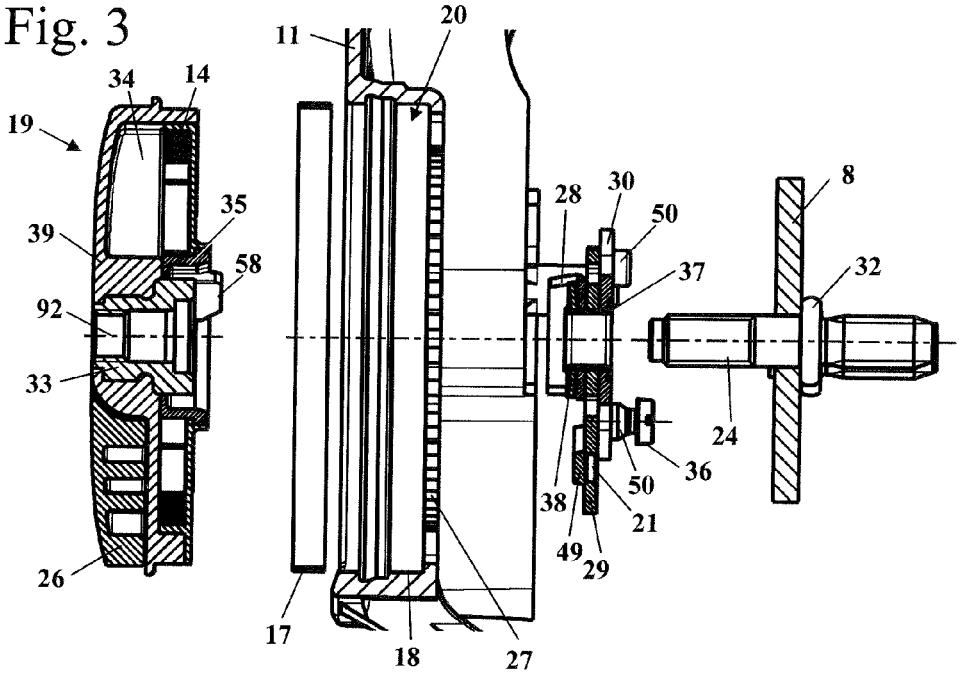
FIG. 3 is a sectioned exploded view of the fastening region of the guide bar.

As FIG. 3 shows, the entrainer 28, the rotary element 29 and the displacement element 30 are connected fixedly to one another in the direction of the rotational axis 92. A rivet sleeve 37 and a disc spring 38 serve to secure the connection. During the tightening of the actuating device 19, the disc spring 38 causes a continuously increasing tightening torque in a structurally predefined angular range. As a result, the operator receives feedback that the screw assembly is fixed and the guide bar 8 is held in a clamped manner. The structurally predefined angular range can be, for example, from approximately 90° to approximately 360°, in particular approximately 180°. The angular range can also extend over more than 360°.

In order to fix the guide bar 8 on the displacement element 30, a fastening screw 36 can be provided which is screwed into a retaining lug 50. As a result, in the case of an actuating device 19, which is not fixed completely, it is prevented that the retaining lugs 50 move out of the openings 23 and bear merely against the guide bar 8. As FIG. 3 also shows, a bead 49 is formed on the helical guide 21. The rotary element 29 is advantageously produced from a thick metal sheet, into which the helical guide 21 is stamped. The bead 49 is produced during stamping of the helical guide 21. The metal sheet can have, for example, a thickness of more than 1 mm. As a result, sufficient mechanical stability of the rotary element 29 is ensured even in the case of high forces which act on the rotary element 29.

As FIG. 3 shows, the tensioning spring 14 of the tensioning device 13 is arranged in an interior space 34 of the actuating device 19. The actuating device 19 has a main body 39 which delimits the interior space 34. A threaded sleeve 33 is held on the main body 39. The threaded sleeve 33 can be connected in a positively locking manner to the main body 39 and/or can be injection-molded into the main body 39 which is advantageously a plastic part. The threaded sleeve 33 serves for screwing the fastening arrangement 12 onto the fastening bolt 24, as FIG. 4 shows.

As FIGS. 3 and 4 show, the tensioning spring 14 is arranged in a spring housing 40 which closes the interior space 34 of the actuating device 19 toward the inner side of the sprocket wheel cover 11. As a result, the tensioning spring 14 is protected against contamination. An entrainer 35 is mounted rotatably on the main body 39. The inner end of the tensioning spring 14 is fixed on the entrainer 35, whereas the outer end is connected fixedly to the main body 39 so that it cannot rotate. The entrainer 35 has at least one entrainer projection 58. In the embodiment, two entrainer projections 58 which lie opposite one another are provided, of which one is shown in FIG. 3. Each entrainer projection 58 protrudes between entrainer projections 43 (shown in FIG. 5) of the entrainer 28 and thus produces a rotationally fixed connection between the inner end of the tensioning spring 14 and the entrainer 28. The entrainer 28 is connected fixedly to the rotary element 29 so as to rotate with it via the recess 44 (shown in FIG. 5) and a lug 45 on the rotary element 29. As a result, the spring force of the tensioning spring 14 acts on the rotary element 29.

As FIG. 4 shows, in the case of a fixed fastening arrangement 12, the threaded sleeve 33 acts via the disc spring 38, the entrainer 28, the rotary element 29 and the displacement element 30 against the guide bar 8 and, as a result, presses the guide bar 8 against the collar 32 and the housing 2 (illustrated diagrammatically in FIG. 4) of the chain saw 1. The threaded sleeve 33, the disc spring 38, the entrainer 28, the rotary element 29 and the displacement element 30 are advantageously composed of metal, which results in satisfactory fixing of the guide bar 8.

On its end side, the main body 39 of the actuating device 19 has an edge 83 which presses against the base 89 of the receptacle 20 and, as a result, presses the sprocket wheel cover 11 against the housing 2, with the result that the sprocket wheel cover 11 is fixed satisfactorily. The main body 39 is advantageously configured in such a way that the clamping force for fixing the sprocket wheel cover 11 is introduced directly into the base 89 of the receptacle 20 of the sprocket wheel cover 11, without further elements, such as the spring housing 40, being arranged in the force flow. This can be achieved by way of a corresponding design of the tolerances or configuration of correspondingly defined bearing faces.

Figure 5:
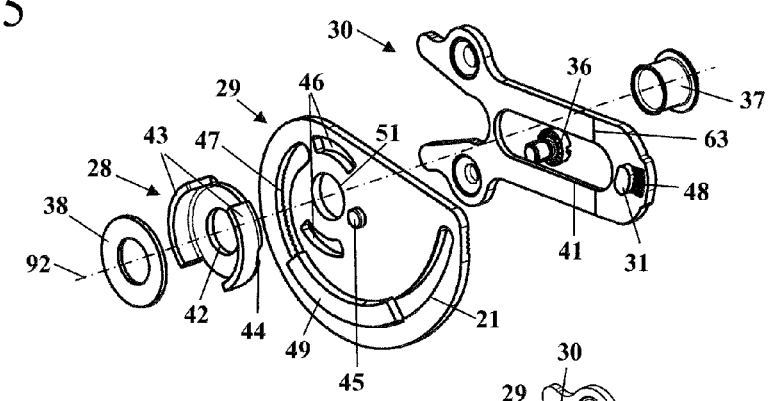
FIGS. 5 to 9 are perspective exploded views of the fastening arrangement.
Figure 6:
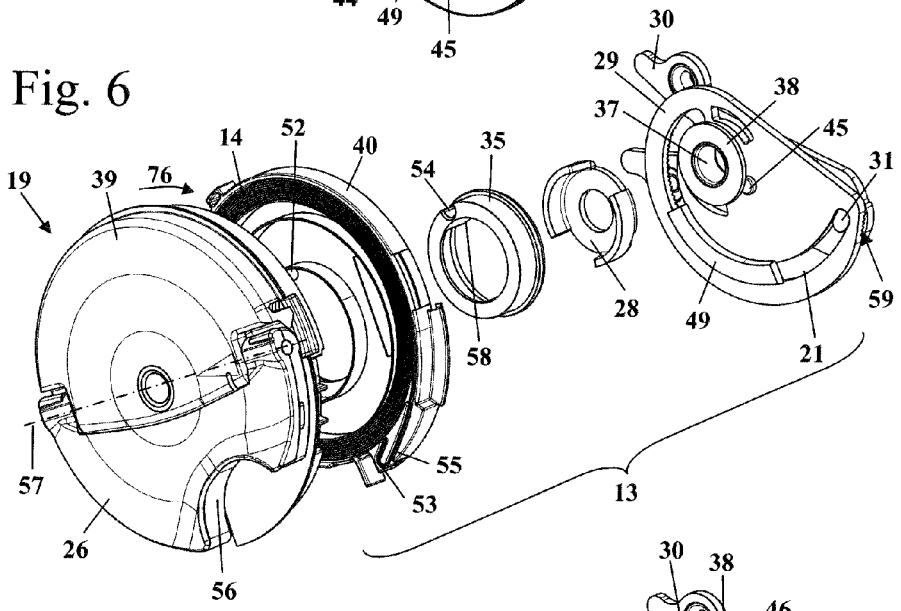
Figure 7:
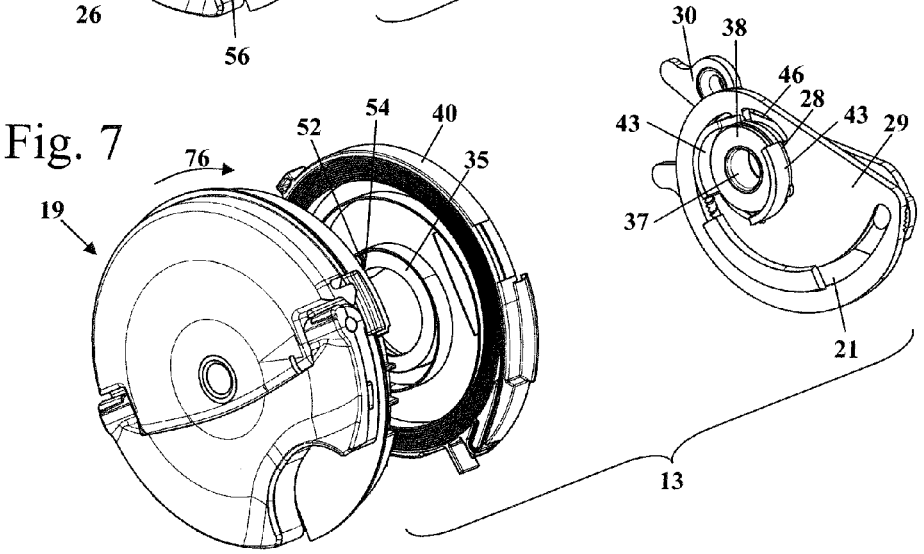

FIGS. 5 to 7 show the construction of the tensioning device 13 in detail. The tensioning device 13 includes a rivet sleeve 37 which projects through the longitudinal slit 41 of the displacement element 30, through an opening 51 in the rotary element 29, through an opening 42 in the entrainer 28 and through the disc spring 38. The rivet sleeve 37 brings about an axially fixed, but rotatable connection of the stated elements to one another. The rotationally fixed connection of the entrainer 28 to the rotary element 29 is achieved via the recess 44 on the entrainer 28 and the lug 45 on the rotary element 29. The rotary element 29 has two driving openings 46 which are oriented in such a way that the entrainer projections 58 of the entrainer 35 (FIG. 3) can engage into the driving openings 46. As a result, a direct rotationally fixed connection can additionally be achieved between the entrainer 35 and the rotary element 29. Depending on the design of the dimensions and tolerances of the entrainer projections 43 of the entrainer 28 and the driving openings 46 in the rotary element 29, the rotationally fixed connection is achieved via the entrainer projections 43, the driving openings 46 or both.

FIG. 6 shows the rotary element 29 with the rivet sleeve 37 and the disc spring 38 without the entrainer 28 which is to be arranged between the disc spring 38 and the rotary element 29, in order to clarify the construction. The actual arrangement, in which the entrainer 28 is arranged between the disc spring 38 and the rotary element 29, is shown in FIG. 7.

As FIG. 5 also shows, a securing contour 48 is formed on the displacement element 30 adjacently with respect to the lug 31. The securing contour 48 is arranged on that side of the lug 31 which faces away from the longitudinal slit 41. The rotary element 29 has a securing contour 47, into which the securing contour 48 engages in the case of a completely fixed fastening arrangement 12. As a result, a positively locking connection of the rotary element 29 and the displacement element 30 is achieved. The securing contours 47 and 48 form a securing device 59 (FIG. 6) which prevents it being possible for the rotary element 29 to rotate during operation with respect to the displacement element 30 and thus to change the tension of the chain 9, in particular to loosen the chain 9.

As FIG. 5 shows, the helical guide 21 extends around the rotational axis 92 by less than one revolution. The angle which the helical guide 21 encloses with the circumferential direction is comparatively large as a result. As a result, the guide bar 8 can move the displacement element 30 counter to the force of the tensioning spring 14 counter to the tensioning direction 15 if the chain tension exceeds the force of the tensioning spring 14 considerably. This can be the case, for example, when the chain 9 is tensioned in the warm state and the tensioning device 13 is then fixed. During cooling, the chain 9 shrinks, as a result of which the chain tension is increased considerably. The chain 9 can then possibly no longer be moved by hand over the guide bar 8.

As FIGS. 6 and 7 show, the tensioning spring 14 is configured as a helical spring. The tensioning spring 14 has an outer end 53 which is fixed in a receptacle 55 of the spring housing 40. The tensioning spring 14 has an inner end 52 which is hooked on a receptacle 54 on the entrainer 35. The actuating device 19 is connected fixedly to the spring housing 40 so as to rotate therewith. A rotation of the actuating device 19 in the fastening direction 76 causes the outer end 53 to move in the fastening direction 76 with respect to the inner end 52 of the tensioning spring 14. As a result, the tensioning spring 14 is tensioned.

Figure 8:
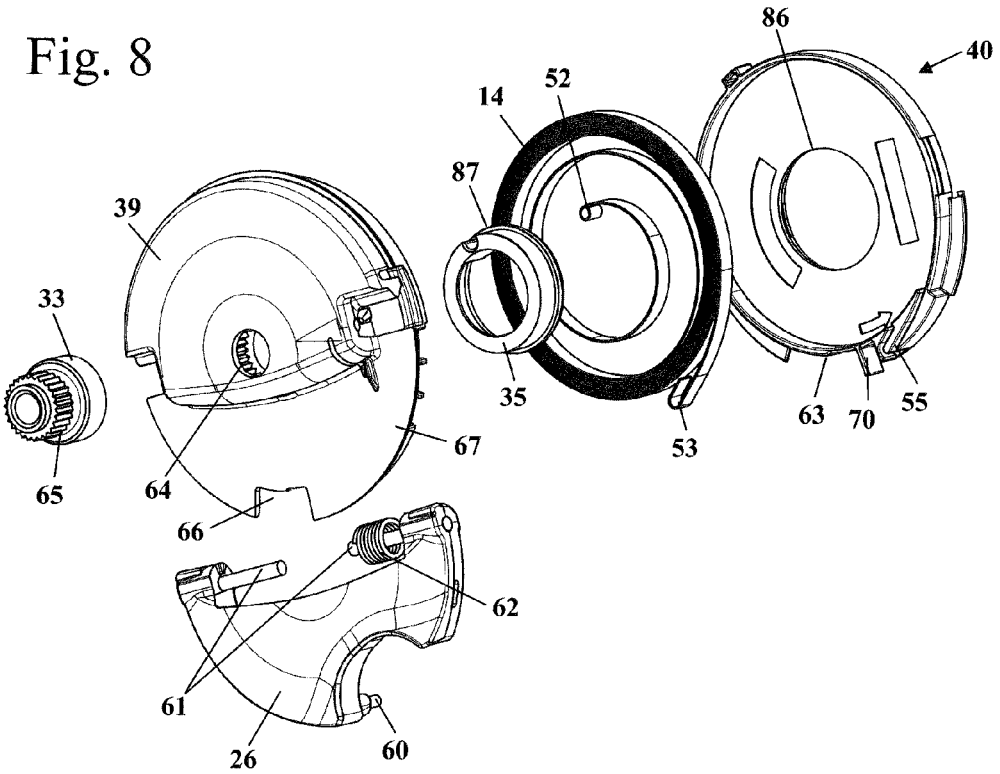

As indicated in FIG. 6, the bracket 26 can be pivoted about a pivot axis 57 with respect to the main body 39 of the actuating device 19. To this end, two bearing pins 61 which are shown in FIG. 8 are provided. The bearing pins 61 mount the bracket 26 pivotably on the main body 39. The bracket 26 is pretensioned via a spring 62 in the direction of its position in which it is folded into the receptacle 20. The bracket 26 has at least one attachment lug 60 which extends approximately parallel to the rotational axis 92 (FIG. 4) when the bracket 26 is folded in. In the folded-in state, the bracket 26 lies adjacent a wall 67 of the main body 39. As FIG. 4 shows, the wall 67 also delimits the interior space 34, with the result that the tensioning spring 14 is protected against contaminants. The wall 67 has a cutout 66, through which the attachment lug 60 projects. The attachment lug 60 engages into the tooth contour 27 (shown in FIGS. 2 and 3) on the base 89 of the receptacle 20 and, as a result, fixes the actuating device 19 in a positively locking manner against rotation on the sprocket wheel cover 11. As FIG. 2 shows, the tooth contour 27 is open toward the interior space of the sprocket wheel cover 11. Dirt which has collected in the region of the tooth contour 27 is pressed by the attachment lugs 60 into the interior of the sprocket wheel cover 11 as a result and passes from there to the surroundings. Clogging of the tooth contour 27 is prevented as a result.

As FIG. 8 also shows, the main body 39 has gear teeth 64, into which gear teeth 65 of the threaded sleeve 33 engage. As a result, the threaded sleeve 33 is held on the main body 39 in a positively locking manner. It can be provided that the toothing systems 64 and 65 are produced separately from one another and the threaded sleeve 33 is pressed into the main body 39. The threaded sleeve 33 with the toothing system 65, however, can also be encapsulated by the main body 39, the toothing system 64 being produced.

Figure 11:
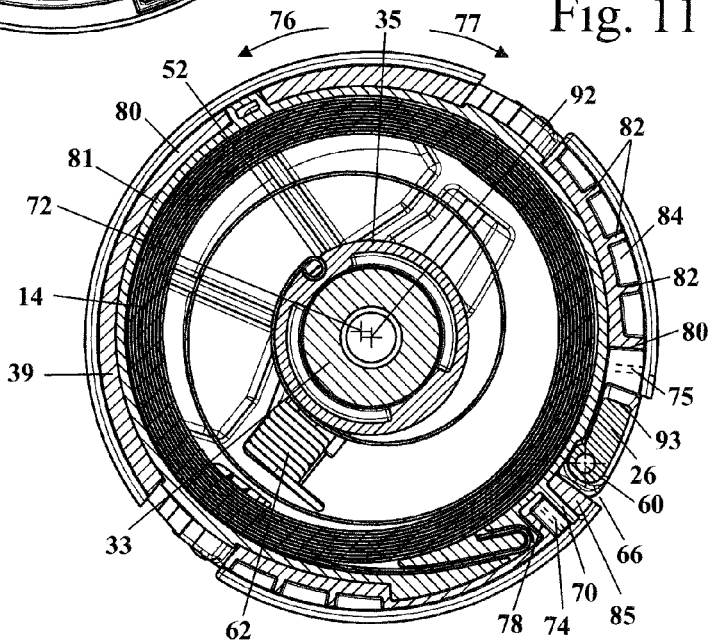
FIG. 11 shows a section along the line XI-XI in FIG. 12.
Figure 12:
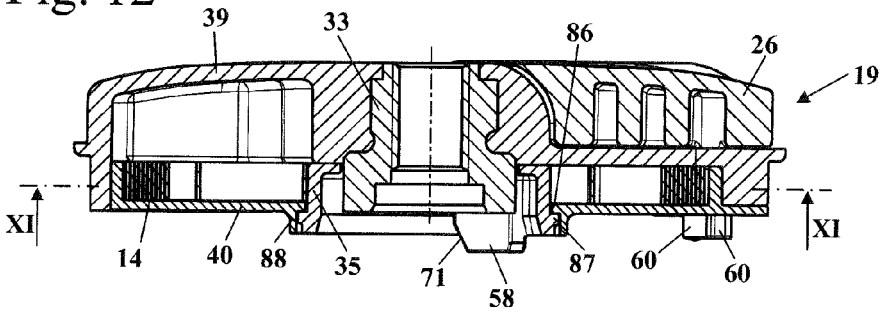
FIG. 12 shows a section through the actuating device of the chain saw.

As FIGS. 8 and 12 show, the spring housing 40 has an opening 86, through which the entrainer 35 projects. The entrainer 35 has an outwardly projecting, circumferential edge 87 which bears against the spring housing 40 adjacently with respect to the opening 86 and secures the entrainer 35 axially. Adjacently with respect to the opening 86, the spring housing 40 has a support 88 which surrounds the region of the edge 87 of the entrainer 35. The entrainer projection 58 projects beyond the support 88. The entrainer projection 58 has a bevel 71 which serves as guide bevel when plugging the entrainer 35 onto the entrainer 28 and facilitates the plugging-on operation. During the actuation of the actuating device 19 in the release direction 77 (FIG. 11), the bevel 71 causes the entrainer projections 58 to pass out of engagement with the entrainer projections 43 (FIG. 7) of the entrainer 28, as soon as the actuating device 19 has been unscrewed to a sufficient extent from the fastening bolt 24 (FIG. 4). This avoids it being possible for the tensioning spring 14 to be damaged as a result of reverse rotation, that is, rotation of the tensioning spring 14 counter to its tightening direction. The arrangement of the entrainer 35 on the spring housing 40 is also shown in FIG. 9.

Figure 9:
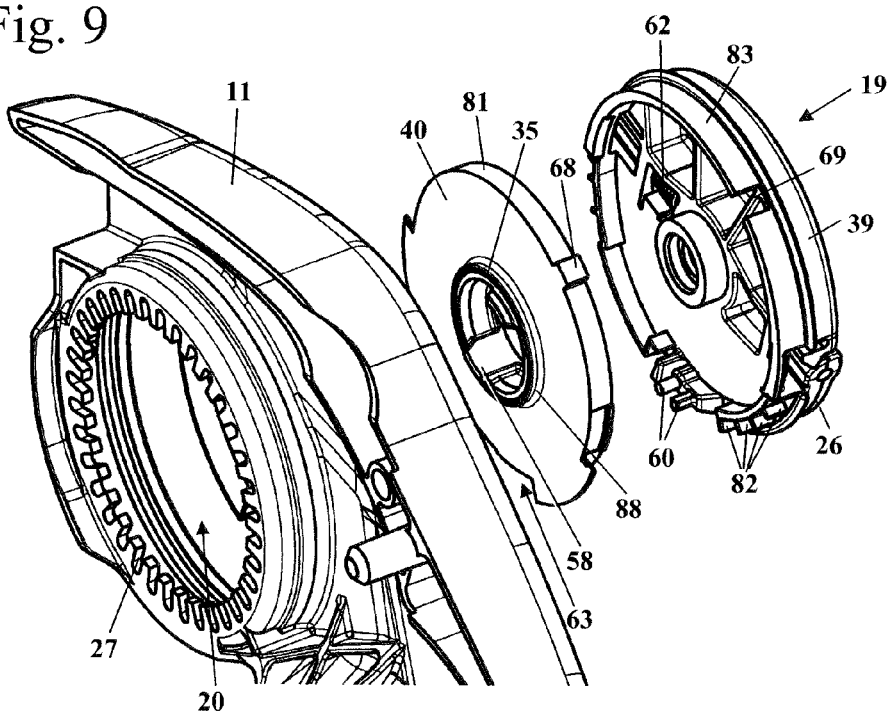

As FIG. 9 shows, the edge 83 of the main body 39 has a cutout 69, into which a lug 68 projects which is formed on the edge 81 of the spring housing 40. As a result, the spring housing 40 and the main body 39 are connected fixedly to one another so as to rotate together. As FIG. 9 also shows, the main body 39 has supporting webs 82 which support the spring housing 40 which can be configured, for example, as a thin injection-molded part made from plastic, and prevent deformation of the spring housing 40.

Figure 10:
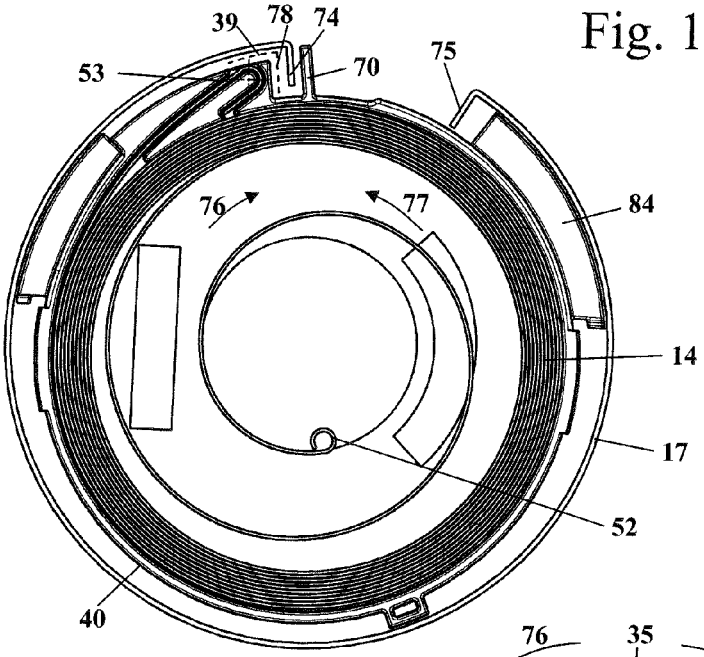
FIG. 10 shows a side view of the tensioning spring, spring housing and friction band.

As FIG. 8 shows, the spring housing 40 has an actuating web 70. FIG. 10 shows the friction band 17 on the spring housing 40. The friction band 17 has a first end 74 and a second end 75. The first end 74 protrudes between the actuating web 70 and a first stop surface 78 which is formed on the spring housing 40. The stop surface 78 is shown in FIG. 11 and is illustrated diagrammatically in FIG. 10. The second end 75 projects between a wall 80 of the main body 39 and a wall 93 on the bracket 26. This is shown diagrammatically in FIG. 11.

In the completely open state of the fastening arrangement 12, the tensioning spring 14 is relaxed. If the actuating device 19 is rotated in the fastening direction 76, that is, in the clockwise direction in the illustration in FIG. 10, the main body 39 of the actuating device 19 and the spring housing 40 move with respect to the friction band 17, until the first stop surface 78 comes into contact with the first end 74 of the friction band 17. The second end 75 is then still at a spacing from the wall 93. The stop surface 78 drives the friction band 17 and, as a result, reduces the diameter of the friction band 17 slightly. This results in a low frictional resistance between the friction band 17 and the friction surface 18, and the actuating device 19 can be actuated simply.

The inner end 52 of the tensioning spring 14 is connected fixedly to the rotary element 29 so as to rotate with it. On account of the frictional resistances between the guide bar 8, the fastening bolt 24, the guide bolt 25 and the housing 2 (FIG. 4), the inner end 52 is held in a stationary manner when the tensioning spring 14 is relaxed. As a result, the tensioning spring 14 is tensioned during the actuation of the actuating device 19 in the fastening direction 76. As soon as the force of the tensioning spring 14 exceeds the frictional forces which act on the rotary element 29, the displacement element 30 and the guide bar 8, the rotary element 29 is rotated and the displacement element 30 is displaced with the guide bar 8 and the chain 9 is tensioned in the process. The maximum tensioning force of the tensioning spring 14 is achieved considerably before the complete fixing of the tensioning device 13, with the result that tensioning of the chain 9 with the desired tensioning force is ensured. Here, the threaded sleeve 33 and the fastening bolt 24 are adapted to the tensioning spring 14 in such a way that the tensioning spring 14 is not yet completely tensioned when the fastening arrangement 12 is fixed completely. The maximum tensioning travel of the tensioning spring 14, that is, the number of revolutions, by which the tensioning spring 14 can be stressed at most, is greater than the maximum actuating travel of the fastening arrangement 12, that is, the number of thread turns, by which the actuating device 19 can be screwed onto the fastening bolt 24, until the guide bar 8 is clamped fixedly between the displacement element 30 and the fastening bolt 24. During the rotation of the actuating device 19 in the fastening direction 76, the threaded sleeve 33 is screwed onto the fastening bolt 24 and the guide bar 8 is fixed as a result. At the same time, the tensioning spring 14 is tensioned. The tensioning spring 14 tensions the chain 9 by displacement of the guide bar 8 in the tensioning direction 15. The tensioning of the chain 9 takes place until the chain 9 bears completely on the guide bar 8. During the last revolution of the actuating device 19, the securing contours 47 and 48 come into positively locking engagement with one another, with the result that the rotary element 29 and the displacement element 30 can no longer be rotated with respect to one another. If the actuating device 19 is rotated further in the fastening direction 76, the guide bar 8 is clamped fixedly and is fixed as a result.

Along the line 63 which is shown in FIG. 5, the displacement element 30 is bent slightly away from the rotary element 29 and toward the guide bar 8. In the case of a released fastening arrangement 12, the securing contours 47 and 48 are not in engagement with one another. The securing contours 47 and 48 come into engagement with one another only when the displacement element 30 comes into contact with the guide bar 8 during tightening of the arrangement and that region of the displacement element 30 which has the lug 31 is bent toward the rotary element 29.

During the release of the fastening arrangement 12, that is, during rotation of the actuating device 19 in the release direction 77, the actuating web 70 comes into contact with the first end 74 of the friction band 17. Here, the second end 75 of the friction band 17 is not in contact with the wall 80. On account of the movement of the actuating web 70 in the release direction 77, the friction band 17 is widened slightly and is pressed against the friction surface 18. As a result, in order to actuate the actuating device in the release direction 77, the operator has to additionally overcome the frictional resistance between the friction band 17 and the friction surface 18. The tensioning spring 14 likewise acts on the spring housing 40 and the actuating device 19 in the release direction 77. If the operator lets go of the actuating device 19 in any desired position which is not fixed completely, the tensioning spring 14 moves the actuating web 70 against the first end 74 of the friction band 17 and, as a result, brings about frictional fixing of the actuating device 19. As a result, automatic reverse rotation of the actuating device 19 on account of the force of the tensioning spring 14 is prevented. A relief of the tensioning spring 14 in the case of a fastening arrangement 12 which is not fixed is arrested by the arresting unit 16. A slight relief of the tensioning spring 14 is possible until the frictional contact of the friction band 17 with the friction surface 18. On account of the spring constant of the tensioning spring 14 which is configured as a helical spring, which spring constant brings about a constant spring force over a wide range, a slight relief of the tensioning spring 14 is not relevant for the function of the tensioning device 13. If the actuating device 19 is screwed completely from the fastening bolt 24, the tensioning spring 14 is relieved completely in the process.

As FIG. 11 shows, the main body 19 has a supporting rib 85 adjacently with respect to the actuating web 70, on which supporting rib 85 the actuating web 70 is supported. As a result, excessive deformation of the actuating web 70 by the first end 74 of the friction band 17 is prevented.

As FIG. 11 also shows, the center axis 72 of the tensioning spring 14 is arranged at a slight spacing from the rotational axis 92 of the actuating device 19. As a result, sufficient installation space is available for the attachment lug 60. At the same time, a great outer circumference of the tensioning spring 14 can be achieved by virtue of the fact that the tensioning spring 14 is arranged at an axial offset with respect to the rotational axis 92. Here, the center axis 72 is the geometric center of the outer winding of the tensioning spring 14. FIG. 11 also shows the hooking of the inner end 52 on the entrainer 35. As FIG. 11 also shows, a region 84 of the spring housing 40 bears against the supporting ribs 85.

Figure 13:
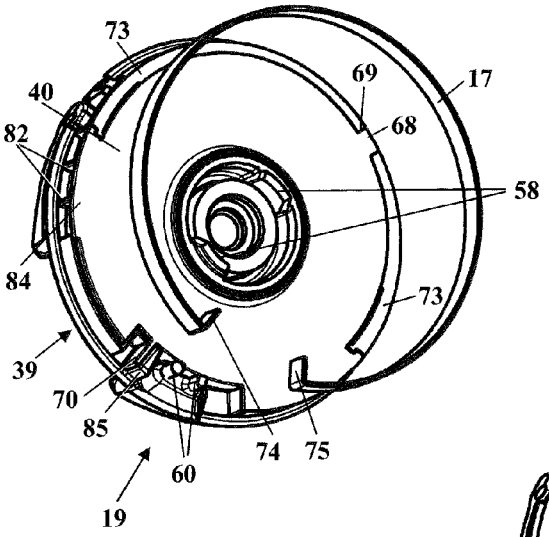
FIG. 13 is a perspective exploded view of the actuating device and the brake band.

As FIGS. 12 to 15 show, two attachment lugs 60 are provided in the exemplary embodiment. A different number of attachment lugs 60 can also be advantageous, for example one or three or more attachment lugs 60. If an attachment lug 60 does not meet a gap during folding in of the bracket 26, but rather a web of the tooth contour 27, this can lead to stripping of the tooth contour 27. In order to reduce the forces which act on the tooth contour 27 and to avoid stripping of the tooth contour 27, a plurality of attachment lugs 60 are advantageous. At least one attachment lug 60 is advantageously composed of metal or has a metal coating. As a result, the wear on the attachment lug 60 can be reduced. FIG. 13 shows the arrangement of the region 84 of the spring housing 40 on the supporting webs 82. As FIG. 13 also shows, the main body 39 engages in a positively locking manner into the spring housing 40. To this end, webs 73 are formed on the main body 39 on both sides of the cutout 69, which webs 73 are part of the edge 83 and act against the base 89 of the receptacle 20 (FIG. 2). The webs 73 cover the tooth contour 27 partially. As a result, it is made more difficult for dirt to be able to pass from the interior space of the sprocket wheel cover 11 through the tooth contour 27 to the friction band 17.

Figure 14:
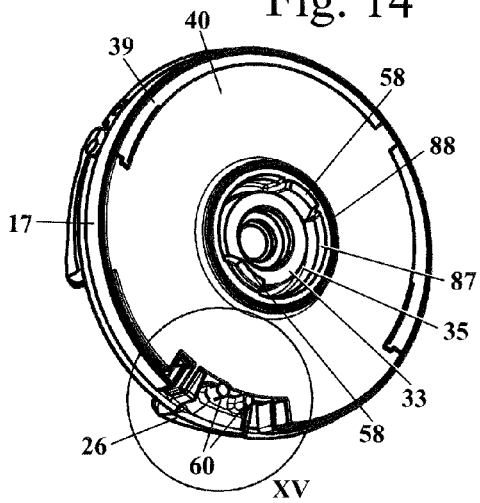
FIG. 14 shows a perspective view of the actuating device and the brake band.

FIGS. 13 and 14 also show the two entrainer projections 58 of the entrainer 35 which are arranged so as to lie opposite one another.

Figure 15:
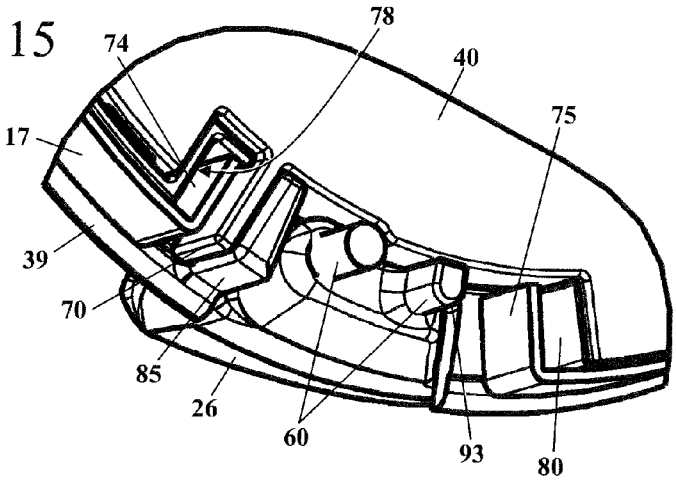
FIG. 15 shows the detail XV of FIG. 14 in an enlarged illustration.

As the enlarged illustration in FIG. 15 shows, the first end 74 lies between the stop surface 78 and the actuating web 70. The spacings from the stop surface 78 and from the actuating web 70 are considerably smaller than those of the second end 75 from the wall 80 or from the wall 93. This ensures that the second end 75 cannot come into contact with the wall 80 or the wall 93. In the exemplary embodiment, the wall 93 is formed on an attachment lug 60. The second end 75 does not have any function during operation. Incorrect mounting of the friction band 17 is not possible as a result of the symmetrical configuration of the friction band 17.

FIGS. 16 to 19 show a further exemplary embodiment for an actuating device 19 and a tensioning device 13. Here, identical designations denote corresponding elements as in the preceding figures, reference being made to the description with respect to the preceding figures.

Figure 16:
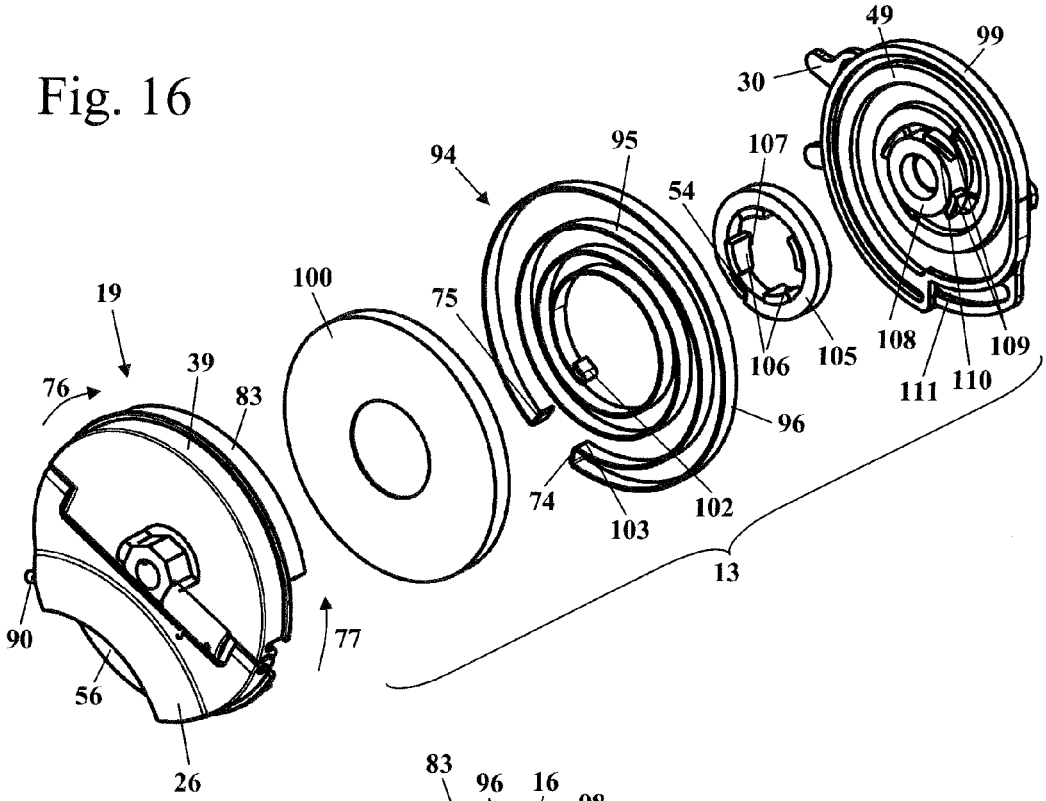
FIG. 16 is a perspective exploded view of one embodiment of a tensioning device of a chain saw.
Figure 17:
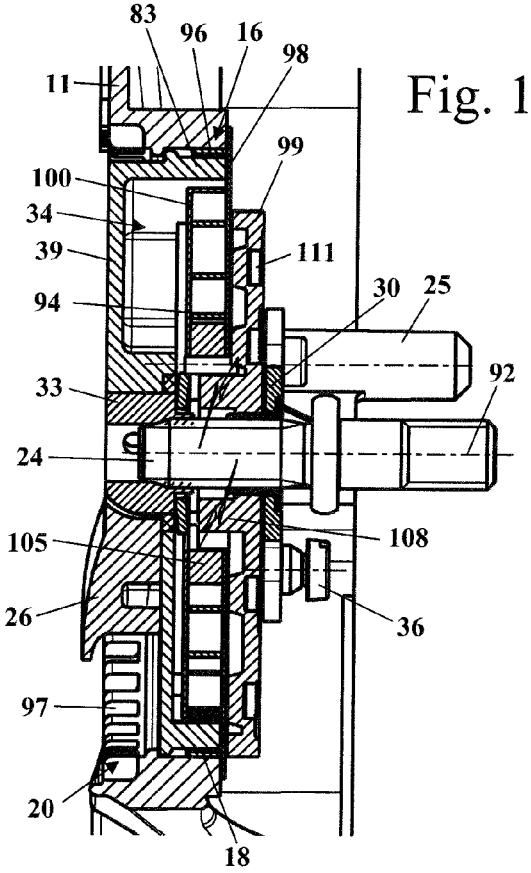
FIG. 17 shows a section through the tensioning device of FIG. 16.

The actuating device 19 from FIG. 16 has a bracket 26 which has an outwardly projecting attachment lug 90. As FIG. 17 shows, a tooth contour 97 which is of closed configuration toward the interior space of the sprocket wheel cover 11 is formed on the receptacle 20.

As FIG. 16 shows, the tensioning device 13 has a spring element 94 which includes a tensioning spring 95 and a friction band 96 which is formed integrally on the tensioning spring 95. The friction band 96 engages around the tensioning spring 95 here in a direction which is opposed to the winding direction of the tensioning spring 95. The first end 74 of the friction band 96 is adjoined by an outer end 103 of the tensioning spring 95. An inner end 102 of the tensioning spring 95 is configured for hooking onto an entrainer 105. To this end, the entrainer 105 has a receptacle 54. The entrainer 105 is of annular configuration and has a total of four entrainer projections 106 on its inner circumference. Each entrainer projection 106 has a bevel 107 which extends over the entire end side of the entrainer projection 106. The tensioning device 13 includes a rotary element 99, onto which the entrainer 108 is formed integrally. The entrainer 108 can also be configured as a separate component and can be fixed on the rotary element 99 fixedly so as to rotate with it. The entrainer 108 has a total of four entrainer projections 109 on its outer circumference, which entrainer projections 109 have bevels 110 on their end side which faces the entrainer 105. The bevels 107 and 110 form guide bevels and facilitate the plugging together of the entrainers 105 and 108.

The rotary element 99 has a helical guide 111 which extends around the rotational axis 92 (FIG. 17) over more than two revolutions. As a result, the helical guide 111 has a self-locking action. As a result, a force which acts on the guide bar 8 and on the displacement element 30 cannot rotate the rotary element 99. The operator has to remove the rotary element 99 manually in order to reduce the chain tension.

As FIG. 16 also shows, the tensioning spring 95 is arranged in a spring housing 100. As FIG. 17 shows, a covering disc 98 which covers the spring housing 100 toward the interior space of the sprocket wheel cover 11 is arranged on the end side of the edge 83 of the main body 39. The covering disc 98 is advantageously fixed on the sprocket wheel cover 11, for example screwed or clipped. In the exemplary embodiment, the spring housing 100 is of substantially closed configuration toward the interior space 34. The entrainer 105 is arranged between the bottom of the spring housing 100 and the covering disc 98. The entrainer 108 engages into the entrainer 105, as a result of which the entrainer projections 106 and 109 come into engagement with one another. As FIG. 17 shows, the friction band 96 surrounds the edge 83 of the main body 39 and is arranged adjacently with respect to a friction surface 18 of the receptacle 20. Together with the friction surface 18, the friction band 96 forms the arresting unit 16.

Figure 18:
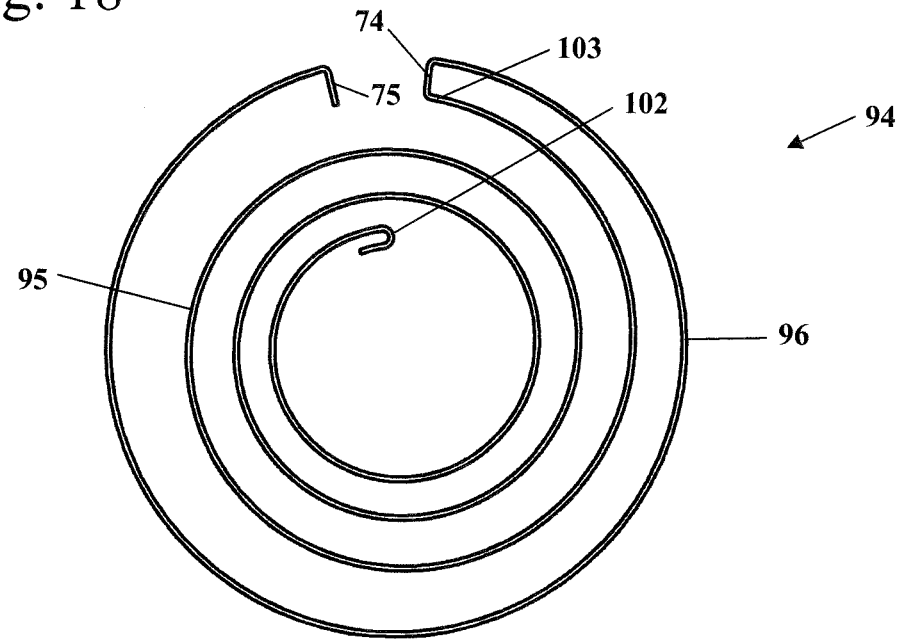
FIG. 18 is a side view of the spring element of the tensioning device of FIGS. 16 and 17.

FIG. 18 shows the construction of the spring element 94 in detail. The tensioning spring 95 has a sufficient number of windings which can correspond, for example, to the number of windings in the first exemplary embodiment. For the sake of improved clarity, only three of the windings of the tensioning spring 95 are shown in the figures. The outer end 103 of the tensioning spring 95 is adjoined by the first end 74 of the friction band 96.

Figure 19:
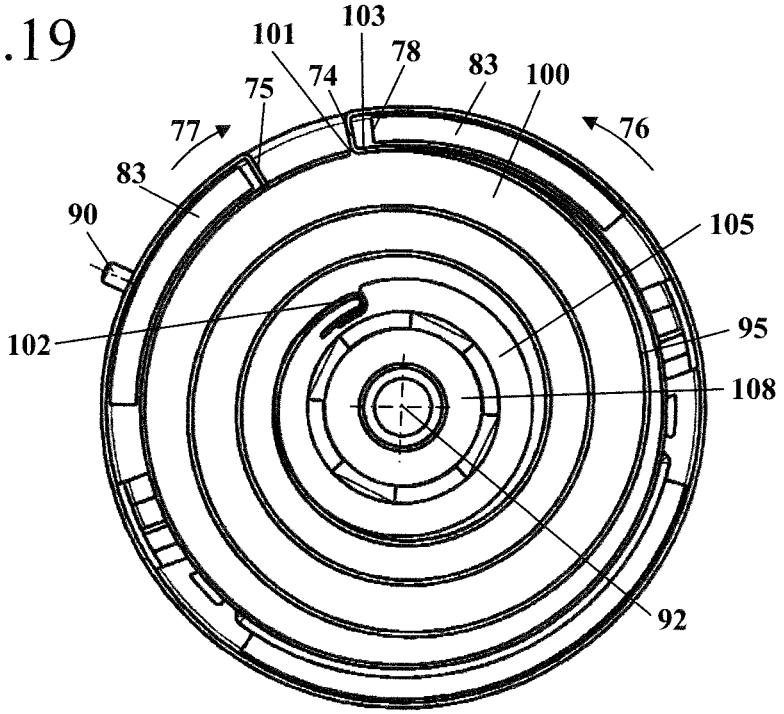
FIG. 19 shows the spring element from FIG. 18 on a spring housing in a side view.

As FIG. 19 shows, the spring housing 100 is arranged coaxially with respect to the rotational axis 92. The spring housing 100 has a passage opening 101, through which the first end 74 of the friction band 96 projects. A stop surface 78 is formed on the main body 39 of the actuating device 19 adjacently with respect to the first end 74 of the friction band 96. If the actuating device 19 is moved in the fastening direction 76, the stop surface 78 drives the friction band 96 at the first end 74 and, as a result, reduces the friction between the friction band 96 and the friction surface 18. At the same time, the outer end 103 of the tensioning spring 95 is driven via the first end 74 and, as a result, the tensioning spring 95 is stressed. If the actuating device 19 is let go, the tensioning spring 95 attempts to relieve itself. Here, it moves the first end 74 in the direction of the stop surface 78 and, as a result, widens the friction band 96 which comes into contact with the friction surface 18. As a result, the movement of the actuating device 19 in the release direction 76 is arrested and further relieving of the tensioning spring 95 is prevented as a result.

Figure 20:
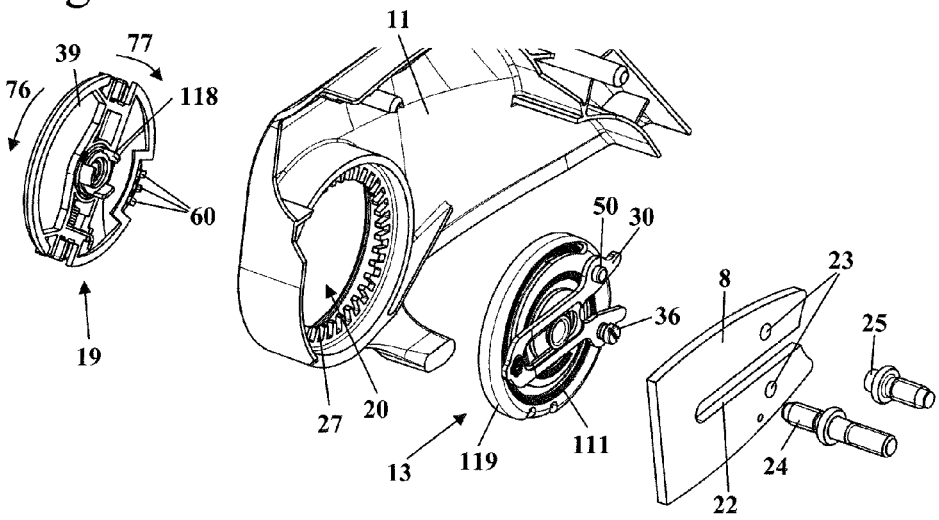
FIGS. 20 to 24 are perspective exploded views of the fastening region of a guide bar of a chain saw.
Figure 21:
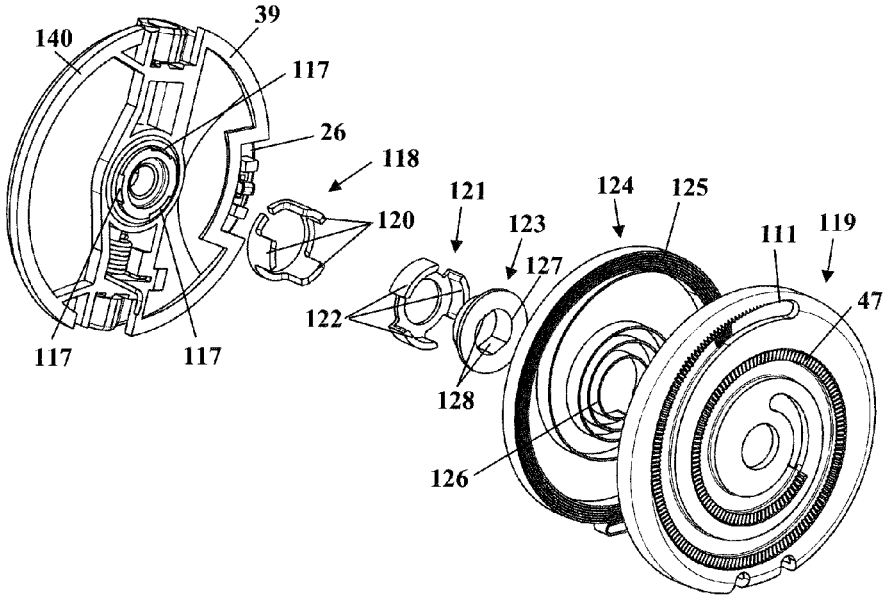

FIGS. 20 to 27 show a further exemplary embodiment of a tensioning device 13, identical designations as in the preceding figures also denoting identical elements here. An entrainer 118 is held on the actuating device 19. As FIG. 21 shows, the entrainer 118 has three entrainer projections 120. The entrainer projections 120 project through openings 117 in the main body 39 of the actuating device 19 and, as a result, are connected in a positively locking manner to the main body 39 in the circumferential direction, that is, in the fastening direction 76 and in the release direction 77. The entrainer 118 can also be encapsulated by the main body 39 of the actuating device 19 and, as a result, can be held on the actuating device 19. A total of three attachment lugs 60 are formed on the bracket 26, which attachment lugs 60 engage into the tooth contour 27 on the sprocket wheel cover 11 in the position of the bracket 26, in which it is folded onto the main body 39, and, as a result, secure the actuating device 19 in a positively locking manner against rotation with respect to the sprocket wheel cover 11.

As FIG. 20 shows, the tensioning device 13 includes a spring housing 119, on which a helical guide 111 is formed. The helical guide 111 corresponds to the helical guide 111 which is shown in FIG. 16 and is of self-locking configuration.

As FIG. 21 shows, the tensioning device 13 includes a spring element 124 which is arranged in the spring housing 119. The spring housing 119 for the spring element 124 forms the rotary element of the tensioning device 13. As FIG. 21 also shows, a securing contour 47 is formed on the spring housing 119 adjacently with respect to the helical guide 111, which securing contour 47 is configured as a fine toothing system and interacts with the securing contour 48 (shown in FIG. 23) on the displacement element 30. The tensioning device 13 includes an entrainer 121 which has entrainer projections 122. A total of three entrainer projections 122 are provided. The spacing between the entrainer projections 122 is selected in such a way that the entrainer projections 120 of the entrainer 118 can engage between the entrainer projections 122. Moreover, the tensioning device 13 includes a sleeve 123 which has an opening 127. Two flattened portions 128 which are arranged so as to lie opposite one another are formed on the opening 127.

Figure 22:
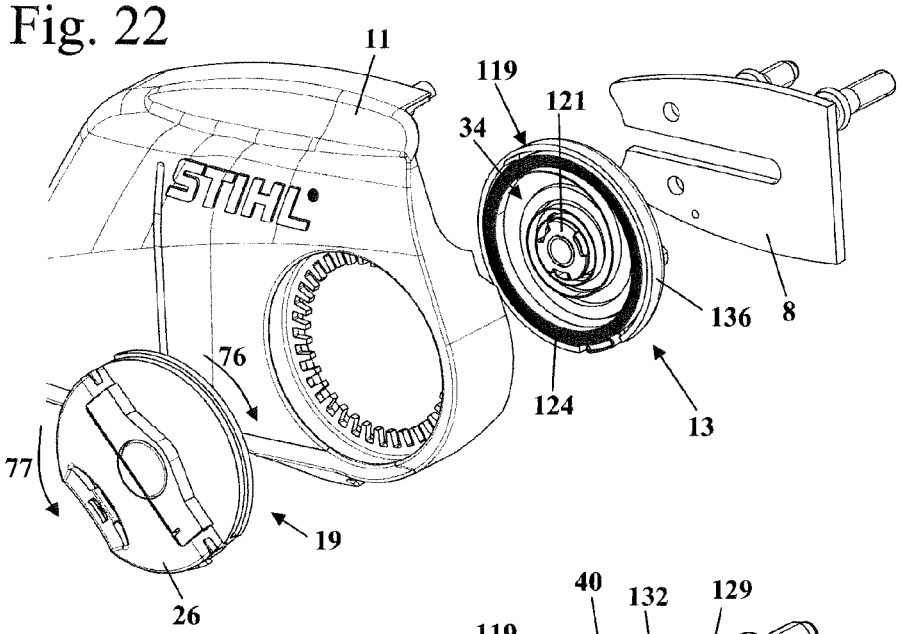

FIG. 22 shows the arrangement of the spring element 124 in the spring housing 119. As FIG. 22 shows, the spring housing 119 has an edge 136 which surrounds the spring element 124.

Figure 23:
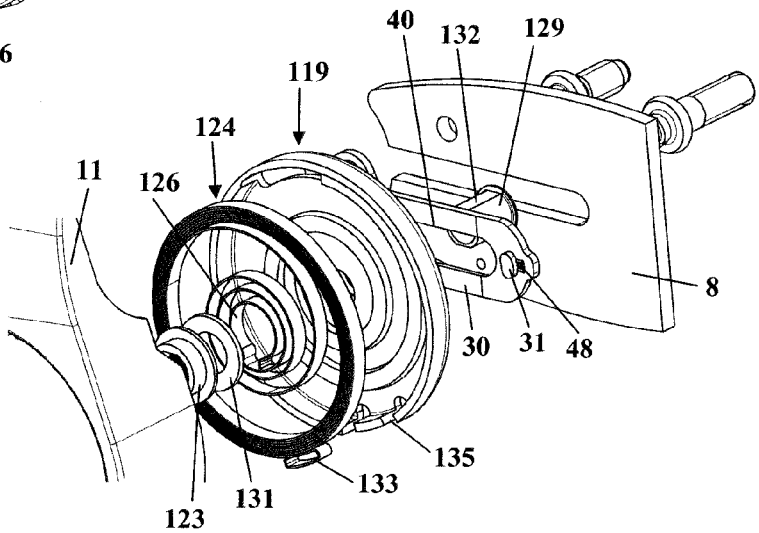

As FIG. 23 shows, a rivet sleeve 129 is provided for connecting the spring housing 119 and the displacement element 30. The rivet sleeve 129 has flattened portions 132 which lie opposite one another, come into contact with the flattened portions 128 of the sleeve 123 in the mounted state and connect the sleeve 123 fixedly to the rivet sleeve 129 so as to rotate with it. Moreover, the flattened portions 132 are dimensioned in such a way that they secure the rivet sleeve 129 in a rotationally fixed manner in the displacement element 30. As a result, a rotationally fixed connection of the sleeve 123 to the displacement element 30 is achieved. Here, the sleeve 123 projects through an opening 130 in the spring housing 119 and through a disc spring 131 which is advantageously arranged on that side of the sleeve 123 which faces away from the displacement element 30.

Figure 24:
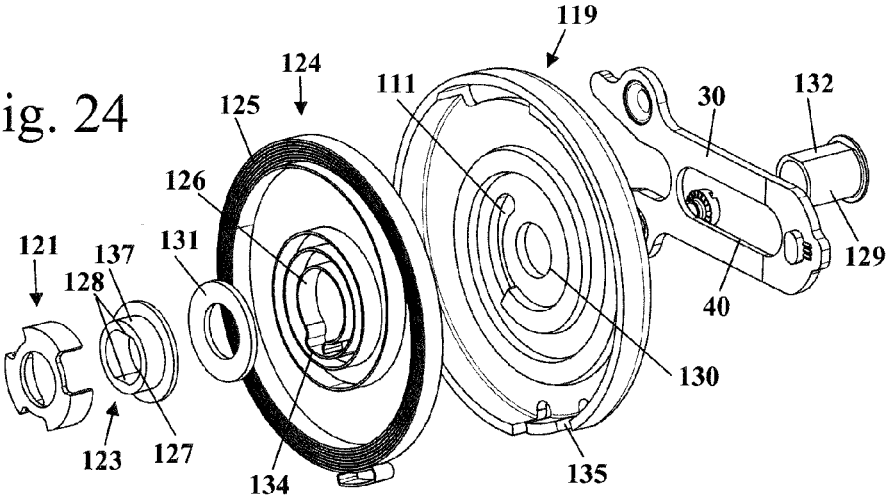

As FIGS. 23 and 24 show, the spring element 124 includes a tensioning spring 125 and a friction band 126. The friction band 126 is formed integrally on the inner end 134 of the tensioning spring 125. The friction band 126 engages around the sleeve 123. A friction surface 137, with which the friction band 126 interacts, is formed on the outer circumference of the sleeve 123. Via the friction band 126, the inner end 134 of the tensioning spring 125 can be connected fixedly to the displacement element 30 so as to rotate with it. The entrainer 121 engages over the sleeve 123 and the friction band 126.

Figure 25:
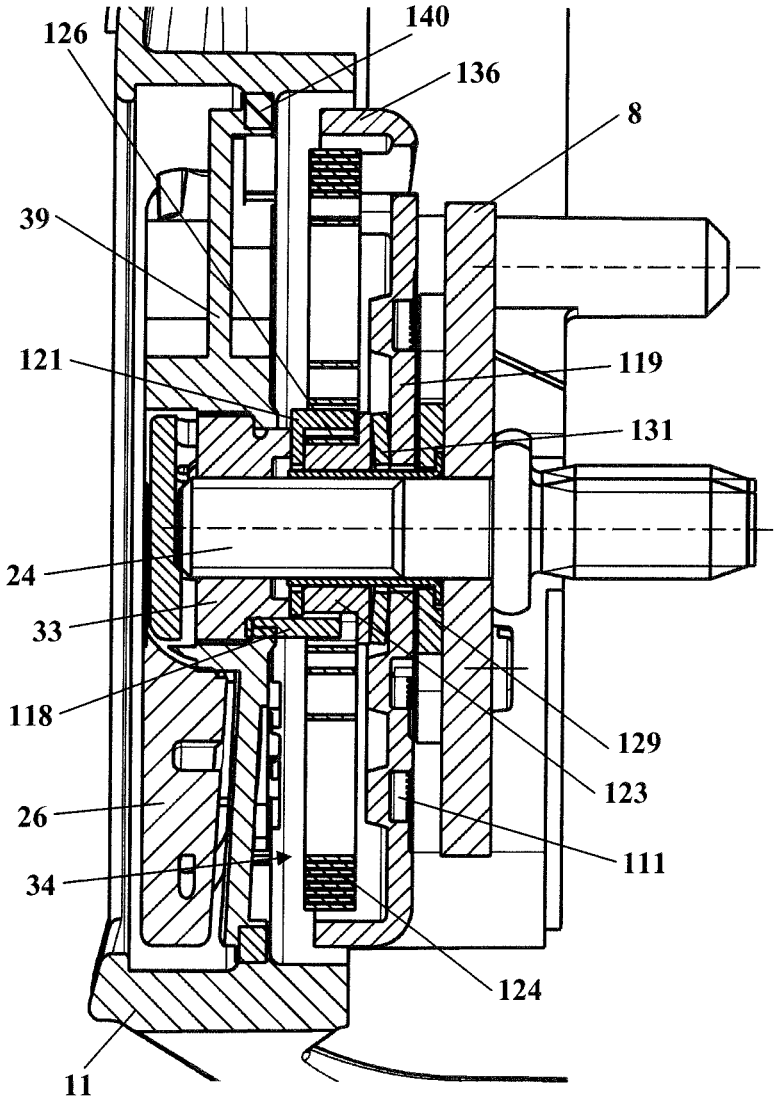
FIG. 25 shows a section through the fastening region of FIGS. 20 to 24.

As FIGS. 20, 21 and 25 show, the main body 39 of the actuating device 19 has an edge 140. As FIG. 25 shows, the edge 136 of the spring housing 119 is arranged adjacently with respect to the edge 140, but is at a spacing from the latter. The main body 39 and the spring housing 119 delimit an interior space 34, in which the spring element 124 is arranged. The interior space 34 is open toward the interior space of the sprocket wheel cover 11 via the gap which is formed between the edges 136 and 140 and via the gap which is formed between the edge 136 and the sprocket wheel cover 11.

Figure 26:
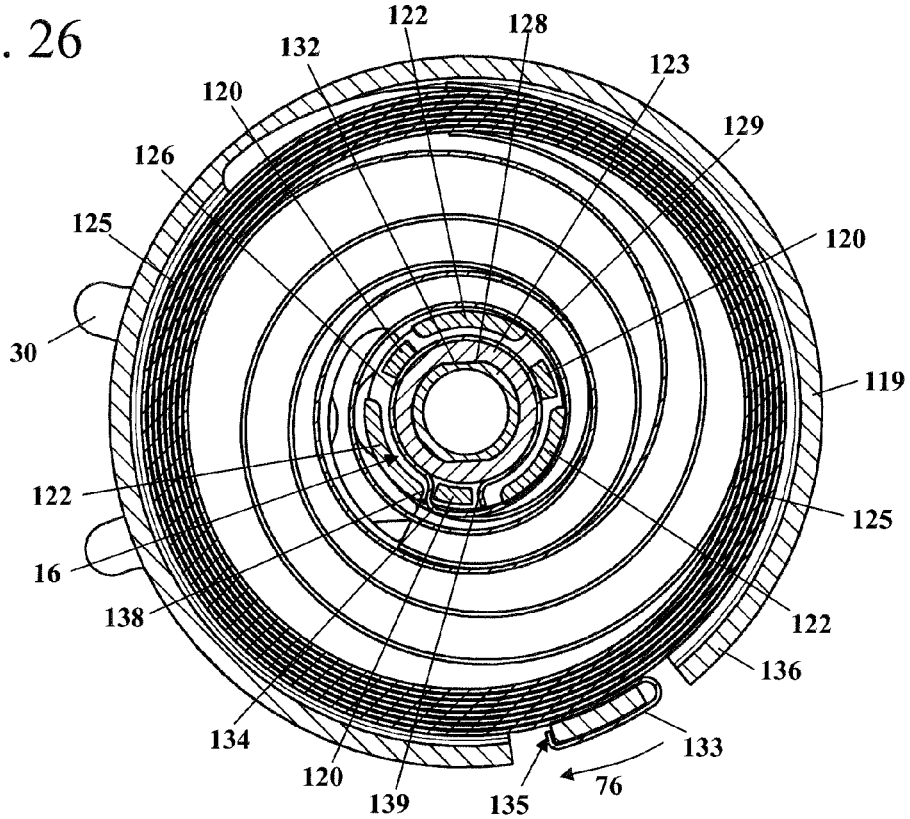
FIG. 26 shows a section through the tensioning device of FIGS. 20 to 24 in the region of the spring element during the actuation of the actuating device in the actuating direction; and, FIG. 27 shows a section through the arrangement of FIG. 26 without the spring housing during an actuation of the actuating device in the release direction.

FIG. 26 shows a section through the spring housing 119. The tensioning spring 125 has an outer end 133 which is hooked on a receptacle 135 of the spring housing 116. The receptacle 135 is formed by two slots in the edge 136 of the spring housing 119. The friction band 126 has a first end 138 which is formed integrally on the inner end 134 of the tensioning spring 125, and a second end 139. The two ends 138 and 139 are arranged on both sides of an entrainer projection 120 of the entrainer 118. During a rotation of the actuating element 19 in the fastening direction 76, an entrainer projection 120 acts against the first end 138 of the friction band 126 and widens the friction band 126 as a result, so that the friction between the friction band 126 and the friction surface 137 of the sleeve 123 (FIG. 24) is reduced. The entrainer projection 120 acts on an adjacent entrainer projection 122 of the entrainer 121 via the first end 138 of the friction band 126. During a rotation of the actuating element 19 in the fastening direction 76, a sleeve of the actuating element 19, which sleeve corresponds to the sleeve 33 which is shown in FIG. 4, is screwed as a result onto the fastening bolt 24 of the chain saw 1 at the same time, and the tensioning spring 125 is wound on the entrainer 121 and is stressed as a result.

If the operator lets the actuating device 19 go, the tensioning spring 125 pulls the first end 138 of the friction band 126 in the direction of the entrainer projection 120 and, as a result, pulls the friction band 126 firmly around the sleeve 123. The rotationally fixed connection of the sleeve 123 to the rivet sleeve 129 and the displacement element 30 prevents it being possible for the tensioning spring 125 to be relieved. Together with the friction surface 137, the friction band 126 forms an arresting unit 16.

Figure 27:
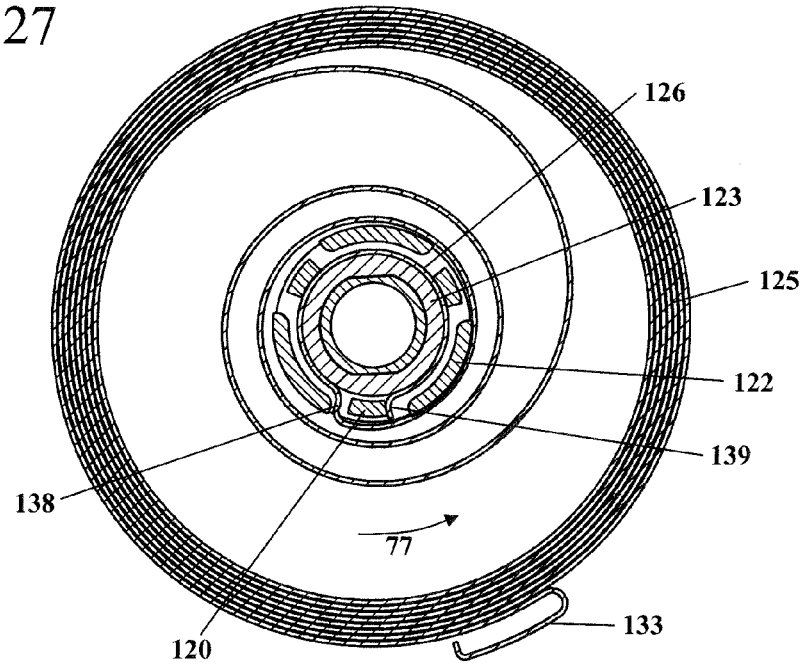

If the operator actuates the operating device in the release direction 77, the entrainer projection 120 moves against the second end 139 of the friction band 126, as FIG. 27 shows. As a result, the friction band 126 is raised slightly from the sleeve 123, and the friction on the friction surface 137 (FIG. 24) is reduced. As a result, the operating force in the release direction 77 is also only low.

It is understood that the foregoing description is that of the preferred embodiments of the invention and that various changes and modifications may be made thereto without departing from the spirit and scope of the invention as defined in the appended claims.

What is claimed is:

1. A portable handheld chain saw comprising:

a housing;

a guide bar defining a longitudinal axis and being mounted on said housing and having a periphery;

a saw chain mounted on said guide bar so as to be movable about said guide bar on said periphery thereof;

a fastening arrangement mounted on said housing adjacent said guide bar;

said fastening arrangement being transferable between a released state wherein said guide bar is shiftable in the direction of said longitudinal axis thereof and a tightened state wherein said guide bar is clamped against said housing;

said fastening arrangement including a threaded member defining a rotational axis and extending laterally from said housing and an actuating device threadably engaging said threaded member so as to be rotatable about said rotational axis in a tightening direction to clamp said guide bar against said housing and to bring said fastening arrangement into said tightened state and rotatable about said rotational axis in a releasing direction to loosen said guide bar and to transfer said fastening arrangement into said released state;

said fastening arrangement further including a tensioning device coupling said actuating device to said guide bar for tensioning said saw chain by moving said guide bar in the direction of said longitudinal axis thereof;

said tensioning device further including a coupling mechanism to translate a rotary motion of said actuating device into a linear movement of said guide bar;

said coupling mechanism including a displacement element mounted on said guide bar and a rotary element coupled to said displacement element for imparting a linear movement to said guide bar via said displacement element in response to a rotational movement of said rotary element about said rotational axis;

said tensioning device further including a spiral spring having a first end connected to said actuating device and a second end; and, an entraining mechanism connected between said second end of said spiral spring and said rotary element for entraining the rotational movement of said actuating device and transmitting the same to said rotary element; and, said spiral spring being configured to be tensioned in response to a manual rotation of said actuating device to impart a torque via said entraining mechanism to said rotary element so as to, in turn, impart said linear movement to said guide bar while said fastening arrangement is still in said released state.

2. The portable handheld chain saw of claim 1, wherein said tensioning device and said guide bar conjointly define an interface; and, said coupling mechanism is disposed at said interface.

3. The portable handheld chain saw of claim 1, wherein:

said actuating device has a main body defining an outer circumference;

a sprocket wheel cover is mounted on said housing and defines a receptacle for accommodating said actuating device therein;

said receptacle and said main body conjointly define a peripheral interface;

said cover defines a friction surface at said peripheral interface;

a friction band is arranged at said peripheral interface; and, said friction surface and said friction band conjointly define an arresting unit configured to prevent a detensioning of said spiral spring when said actuating device is released by an operator.

4. The portable handheld chain saw of claim 3, wherein said guide bar has a fastening region configured to be covered by said sprocket wheel cover.

5. The portable handheld chain saw of claim 3, wherein:

said friction band is connected to said actuating device so as to rotate therewith in a friction reducing direction wherein friction is reduced at said peripheral interface and in a friction increasing direction wherein friction is increased at said peripheral interface;

said actuating device is configured to act on said friction band in said friction reducing direction when said actuating device is rotated in said tightening direction and a frictional resistance between said friction band and said friction surface is reduced;

said actuating device is configured to be rotated by an operator in a releasing direction opposite to said tightening direction; and, said spiral spring is configured to act on said friction band in said friction increasing direction when said actuating device is rotated in said releasing direction and the frictional resistance between said friction band and said friction surface is increased.

6. The portable handheld chain saw of claim 5, wherein:

said friction band has a first end and a second end being operatively connected to said actuating device; and, said actuating device is configured to act on said first end of said friction band when rotated in said tightening direction and to act on said second end of said friction band when rotated in said releasing direction.

7. The portable handheld chain saw of claim 5, wherein said friction band is formed as one piece with said spiral spring.

8. The portable handheld chain saw of claim 1, wherein said spiral spring is detensioned when said fastening arrangement is entirely in said released state.

9. The portable handheld chain saw of claim 1, wherein:

said actuating device at least partially delimits an interior space; and, said spiral spring is arranged in said interior space.

10. The portable handheld chain saw of claim 1, wherein:

said guide bar is configured to be arranged in a plurality of guide bar positions; and, said tensioning device includes a displacement guide having a plurality of rotational positions each of which corresponds to one of said guide bar positions.

11. The portable handheld chain saw of claim 10, wherein said displacement guide is a helical guide; and, the portable handheld chain saw further comprises a lug configured to be guided in said helical guide.

12. The portable handheld chain saw of claim 10, wherein said displacement guide is operatively connected to said spiral spring.

13. The portable handheld chain saw of claim 10, wherein said tensioning device has a securing device configured to secure the rotational position of said displacement guide in a form-fitting manner.

14. The portable handheld chain saw of claim 10, wherein said spiral spring includes a spring housing; and, said displacement guide is formed on said spring housing.

15. A portable handheld chain saw comprising:

a housing;

a guide bar having a periphery and defining a longitudinal axis and a free end projecting away from said housing;

a saw chain mounted on said guide bar so as to be movable about said guide bar on said periphery thereof;

said guide bar being configured to be movable together with said saw chain along said longitudinal axis toward the free end of said guide bar thereby defining a tensioning direction;

a fastening arrangement mounted on said housing adjacent said guide bar;

said fastening arrangement being transferable between a released state wherein said guide bar is shiftable in the direction of said longitudinal axis thereof and a tightened state wherein said guide bar is clamped against said housing;

said fastening arrangement including a threaded member defining a rotational axis and extending laterally from said housing and an actuating device threadably engaging said threaded member so as to be rotatable about said rotational axis in a tightening direction to clamp said guide bar against said housing and to bring said fastening arrangement into said tightened state and rotatable about said rotational axis in a releasing direction to loosen said guide bar and to transfer said fastening arrangement into said released state;

said fastening arrangement further including a tensioning device coupling said actuating device to said guide bar for tensioning said saw chain by moving said guide bar in the direction of said longitudinal axis thereof;

said tensioning device further including a coupling mechanism to translate a rotary motion of said actuating device into a linear movement of said guide bar;

said coupling mechanism including a displacement element mounted on said guide bar and a rotary element coupled to said displacement element for imparting a linear movement to said guide bar via said displacement element in response to a rotational movement of said rotary element about said rotational axis;

said tensioning device further including a spiral spring having a first end connected to said actuating device and a second end; and, an entraining mechanism connected between said second end of said spiral spring and said rotary element for entraining the rotational movement of said actuating device and transmitting the same to said rotary element;

said spiral spring being configured to be tensioned in response to a manual rotation of said actuating device in said tightening direction to impart a torque via said entraining mechanism to said rotary element so as to, in turn, impart said linear movement to said guide bar while said fastening arrangement is still in said released state;

a cover for accommodating said actuating device therein;

a friction band arranged on an outer circumference of the actuating device;

said cover having a friction surface adjacent said friction band;

said friction surface and said friction band conjointly defining an arresting unit configured to prevent a detensioning of said spiral spring when said actuating device is released by arresting the rotation of said actuating device in response to a tension force stored in said spiral spring;

said friction band being configured to rotate together with said actuating device in a friction reducing direction and in a friction increasing direction and to act against said friction surface;

said actuating device being configured to act on said friction band in said friction reducing direction when said actuating device is rotated in said tightening direction and a frictional resistance between said friction band and said friction surface is reduced;

said actuating device being configured to be rotated by an operator in a releasing direction opposite to said tightening direction; and, said tensioning spring being configured to act on said friction band in said friction increasing direction when said actuating device is rotated in said releasing direction and the frictional resistance between said friction band and said friction surface is increased.

* * * * *